US006583765B1

(12) United States Patent
Schamberger et al.

(10) Patent No.: US 6,583,765 B1
(45) Date of Patent: Jun. 24, 2003

(54) SLOT ANTENNA HAVING INDEPENDENT ANTENNA ELEMENTS AND ASSOCIATED CIRCUITRY

(75) Inventors: Mark Allen Schamberger, South Elgin, IL (US); Seth David Silk, Barrington, IL (US); Stephen Leigh Kuffner, Algonquin, IL (US)

(73) Assignee: Motorola, Inc., Schaumburg, IL (US)

( * ) Notice: Subject to any disclaimer, the term of this patent is extended or adjusted under 35 U.S.C. 154(b) by 6 days.

(21) Appl. No.: 10/027,654

(22) Filed: Dec. 21, 2001

(51) Int. Cl.[7] ..... H01Q 13/10
(52) U.S. Cl. ..... 343/770
(58) Field of Search ..... 343/767, 770, 343/771

(56) References Cited

U.S. PATENT DOCUMENTS

| | | | | |
|---|---|---|---|---|
| 4,125,837 A | | 11/1978 | Kaloi | |
| 4,843,403 A | | 6/1989 | Lalezari et al. | |
| 5,021,799 A | | 6/1991 | Kobus et al. | |
| 6,031,503 A | | 2/2000 | Preiss, II et al. | |
| 6,034,644 A | | 3/2000 | Okabe et al. | |
| 6,043,785 A | | 3/2000 | Marino | |
| 6,052,093 A | | 4/2000 | Yao et al. | |
| 6,061,032 A | * | 5/2000 | Sandstedt et al. | 343/770 |
| 6,211,825 B1 | | 4/2001 | Deng | |
| 6,246,377 B1 | * | 6/2001 | Aiello et al. | 343/770 |

OTHER PUBLICATIONS

W.A. Johnson, M.A.; "*The Notch Aerial and Some Applications to Aircraft Radio Installations*"; IEEE Proc. (London), part B, vol. 102, Paper No. 1742 R Mar. 1955, pp. 211–218.

* cited by examiner

*Primary Examiner*—Michael C. Wimer
(74) *Attorney, Agent, or Firm*—Kenneth A. Haas

(57) ABSTRACT

A slot antenna has independent antenna elements. A multilayer dielectric substrate has a conductive layer. A pair of coplanar elongated slots is formed in the conductive layer and configured in a substantially collinear fashion with one another. A pair of transmission lines of conductive traces is formed on the multilayer dielectric substrate coupled to a respective slot. Preferably the pair of slots is notches configured in directions opposing one another. In a further aspect of the invention an additional slot is formed in the conductive layer between the pair of the slots and an additional transmission line of a conductive trace is formed on the multilayer dielectric substrate and coupled thereto. For polarization diversity, the another slot can be configured orthogonally relative to the pair of the slots. Associated application circuitry can be disposed on the same dielectric substrate as the antenna element.

15 Claims, 2 Drawing Sheets

SLOT ANTENNA HAVING INDEPENDENT ANTENNA ELEMENTS AND ASSOCIATED CIRCUITRY

BACKGROUND OF THE INVENTION

1. Technical Field

The present invention relates to slot antennas and, more particularly, relates to a compact configuration for a plurality of slot antenna elements.

2. Description of the Related Art

Because they can be made conformal to metallic surfaces, arrays of slot antennas have been used in aeronautical applications. The antenna elements in these prior aeronautical applications have been spaced relatively far apart to avoid coupling between the antenna elements.

A compact slot antenna is desired with low coupling between the antenna elements. Further, a slot antenna having separately connected antenna elements for different functions is desired.

SUMMARY OF THE INVENTION

A slot antenna has electrically independent antenna elements in close proximity with low mutual coupling therebetween. A multilayer dielectric substrate has a conductive layer. A pair of coplanar elongated slots is formed in the conductive layer and configured in a substantially collinear fashion with one another. A pair of transmission lines of conductive traces is formed on the multilayer dielectric substrate coupled to a respective slot. Preferably the pair of slots is notches configured in directions opposing one another. In a further aspect of the invention an additional slot is formed in the conductive layer between the pair of the slots and an additional transmission line of a conductive trace is formed on the multilayer dielectric substrate and coupled thereto. Preferably the another slot is orthogonally configured relative to the pair of the slots to provide for polarization diversity with minimal coupling.

Associated application circuitry can be disposed on the same dielectric substrate as the antenna element. Depending on the antenna application desired, receive and transmit amplifiers can be directly coupled to the antenna transmissions lines, thus avoiding the need for a duplexer or transmit/receive switch component. For diversity applications that use a single receiver, a diversity switch can be used to select between two of the antenna elements, preferably to the orthogonal antennas for polarization diversity.

The details of the preferred embodiments of the invention may be readily understood from the following detailed description when read in conjunction with the accompanying drawings wherein:

DETAILED DESCRIPTION OF THE PREFERRED EMBODIMENTS

Figure 1:
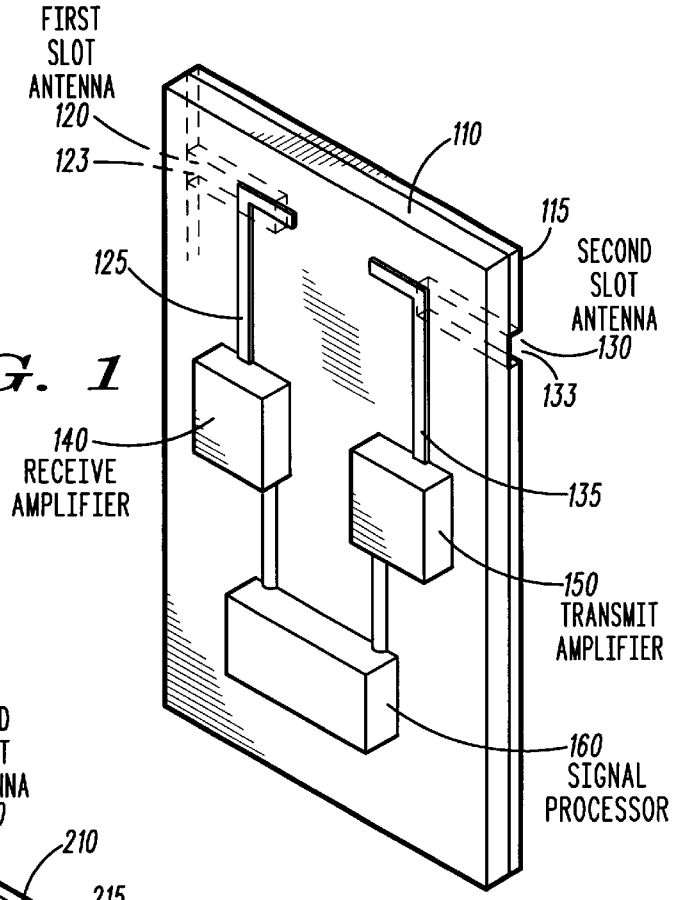
FIG. 1 illustrates an isometric view of a substrate having a plurality of notch antenna elements according to a first embodiment of the present invention.

FIG. 1 illustrates an isometric view of a dielectric substrate 110 having a pair of first and second slot antenna elements 120 and 130 according to a first embodiment of the present invention. Application components are also illustrated disposed on the same dielectric substrate 110 as the antenna elements 120 and 130. The first slot antenna element 120 is made up of a first elongated slot 123 and a first transmission line 125. The second slot antenna element 130 is made up of a collinear, second elongated slot 133 and a second transmission line 135.

A conductive layer 115 of a low loss metal such as copper is illustrated in FIG. 1 on a back surface of the dielectric substrate 110. First elongated slot 123 and second elongated slot 133 are formed in the conductive layer 115. The first and second elongated slots 123 and 133 are configured in a substantially collinear fashion. The first and second elongated slots 123 and 133 are preferably configured in directions opposing one another, end-to-end. The first and second elongated slots 123 and 133 are preferably notches at opposing right and left edges of the conductive layer 115. Although slots 123 and 133 are preferably notches at the edges, they can be slots formed of rectangular holes in the conductive layer 115 that are distanced from the edges of the conductive layer 115. Depending on the distance of the slots from the edges, their performance will still yield acceptable results.

Although a rectangular slot is preferred, the slots can be tapered or flared. The length and width of the slots are most directly related to the frequency of operation. The frequency of interest of the preferred embodiment was 3.7 Gigahertz with a 400 MHz bandwidth. The slot is preferably a quarter wave length notch at this frequency of interest in length and 100 mils (2.54 mm) in width.

First transmission line 125 is disposed on a surface of the dielectric substrate 110 opposite the conductive layer 115 and coupled to the first elongated slot 123. Second transmission line 135 is also disposed on the same or a different surface of the dielectric substrate 110 opposite the conductive layer 115 and coupled to the first elongated slot 133. The first and second transmission lines 125 and 135 are preferably microstrip transmission lines. The transmission lines 125 and 135 preferably extend a quarter wavelength, at the frequency of interest, beyond the point of excitation so that a short circuit impedance is presented to the underlying conductive plane 115 upon which the slots are disposed. Alternatively a shorting via may be used immediately after crossing the slot to connect the transmission line to the conductive plane 115. The point of excitation of each elongated slot is near an end of each slot. For a compact antenna structure, the transmission lines can be bent or meandered. Preferably, the transmission lines are bent beyond the point of excitation in an L-shape. Each transmission line is preferably disposed over its respective slot at an end of the slot opposite the edge of the conductive layer.

The length of the transmission line beginning at the point of excitation of the slot can be adjusted to tune the antenna element. In the preferred embodiment, the transmission line beyond the point of excitation has a length of preferably one quarter wavelength and a uniform with of 50 mils (1.27 mm). The exact length of the transmission line can be adjusted to tune the resonance of the slot element. The transmission lines tested and built have a 50 Ohm input impedance. The transmission line widths can be adjusted to accommodate other desired impedances for associated circuitry.

The distance between the first slot 123 and the second slot 133 should be as large as practical along the collinear axis. Nevertheless, for a compact structure, the slots 123 and 133 can be placed close together using the configuration of the present invention. The present invention provides the configuration that has excellent isolation characteristics between the slots even when placed in close proximity to one another.

A receive amplifier 140 is coupled to the first notch antenna 120. A transmit amplifier 150 is coupled to the second notch antenna 130. A digital signal processor 160 is coupled to the receive amplifier 140 and the transmit amplifier 150. By directly coupling the first antenna 120 to the receive amplifier 140 and the second antenna 130 to the transmit amplifier 150, a duplexer or transmit/receive switch component is avoided. Most conventional cellular telephones have a single antenna with a duplexer or transmit/receive switch component connecting the single antenna to transmit and receive amplifiers of the cellular radio. The need for a duplexer or a transmit/receive switch is avoided by the dual antenna structure illustrated in the first embodiment of FIG. 1. Also, by disposing the application components 140, 150 and 160 on the same dielectric substrate 110 as the first and second antennas 120 and 130, a compact arrangement is also provided.

Figure 2:
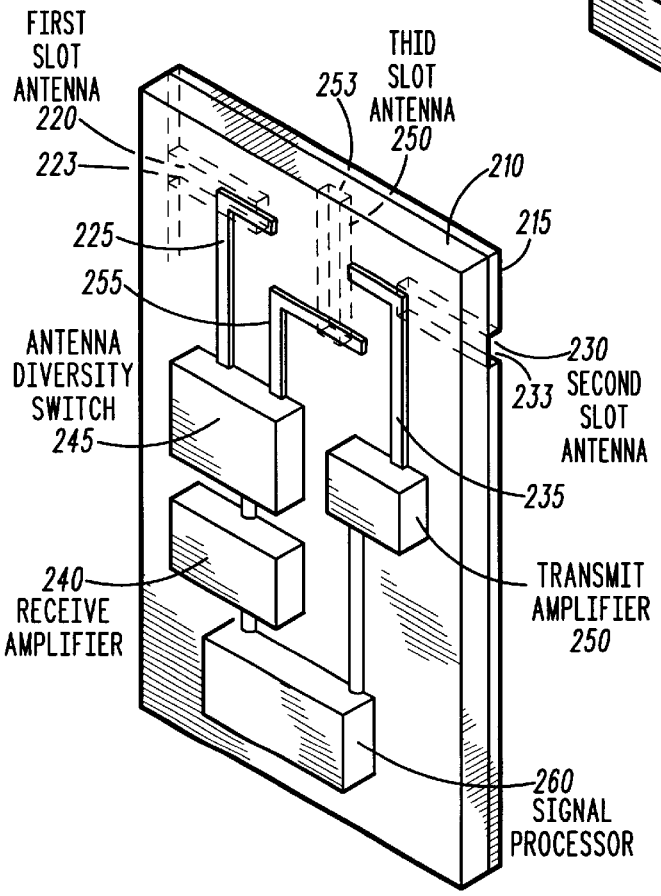
FIG. 2 illustrates an isometric view of a substrate having a plurality of notch antenna elements according to a second embodiment of the present invention.

FIG. 2 illustrates an isometric view of a substrate having a plurality of slot antenna elements according to a second embodiment of the present invention. A first slot antenna element 220 is made up of a first elongated slot 223 and a first transmission line 225. A second slot antenna element 230 is made up of a substantially collinear, second elongated slot 233 and a second transmission line 235. A third notch antenna element 250 is made up of an orthogonal, third elongated slot 253 midway between the first and second slots and a third transmission line 355.

A conductive layer 215 is provided on a backside of a dielectric substrate 210 as illustrated. First and second elongated slots 223 and 233 are formed in the conductive plane 215 configured in a substantially collinear fashion with one another.

First transmission line 225 is provided on a surface of the dielectric substrate 210 in close proximity to the conductive layer 215 and coupled to the first elongated slot 223. Second transmission line 235 is provided on the same or a different surface of the dielectric substrate 210 in close proximity to the conductive layer 215 and coupled to the second elongated slot 233. The first and second transmission lines 225 and 235 are preferably microstrip transmission lines. The transmission lines 225 and 235 are also preferably quarter wavelength transmission lines at a frequency of interest beyond a point of excitation of each slot.

A third slot 253 is formed in the conductive layer 215 is located midway between the first and second slots 223 and 235 as illustrated in FIG. 2. A third transmission line 255 is provided on the same or a different a surface of the dielectric substrate 210 opposite the conductive layer 215 and coupled to the third elongated slot 253. The third transmission line 255 is also preferably a microstrip transmission line that is a quarter wavelength at the frequency of interest, beyond a point of excitation of the slot.

The third slot 253 and the third transmission line 255 makeup a third notch antenna element 250. The slot 253 is preferably configured orthogonal to the collinearly placed slots 223 and 233. By placing the third slot 253 orthogonal to the first and second slots 223 and 233, the third antenna 250 has an orthogonal polarization to the first and second antennas 220 and 230. Polarization diversity antennas are thus provided by the orthogonal arrangement of the antenna elements.

The point of excitation of each slot in both the first embodiment and the second embodiment of either FIG. 1 or FIG. 2 is approximately near the end of each elongated slot; thus, the length of the transmission line beyond its slot should be about a quarter wavelength at the frequency of interest. For a compact antenna structure, the transmission lines can be bent or meandered. Preferably, the transmission lines are bent beyond the point of excitation in an L-shape. Each transmission line is preferably disposed over its respective slot at an end of the slot opposite the edge of the conductive layer.

The length of the transmission lines beyond the point of excitation of the slots 223, 233 and also 253 can be adjusted to tune the antenna element. In the preferred embodiment, the transmission line beyond the plant excitation has a length of preferably one quarter wavelength and a uniform width of 50 mils (1.27 mm). The transmission lines tested and build had a 50 Ohm input impedance.

In the second embodiment of the present invention, the slots 123 and 133 are distanced by 800 mils (20.32 mm) when measured between the inner, excited ends of the slots, but could get twice as close without a third slot in the middle as in the embodiment of FIG. 1. The present invention provides a configuration that has excellent isolation characteristics between the slots even when placed in close proximity to one another.

The antennas of the present invention can work down to 2 GHz or lower. A much lower frequency of operation than 2 GHz would cause the antenna structure to get very large. The size of the antenna can be reduced by choosing materials with higher dielectric constants. In practice, though, inexpensive dielectrics may be used.

The dielectric substrates 110 and 210 are preferably a low loss material having multiple layers and a low loss metal such as copper or a silver alloy. For the size and frequency of operation in the preferred embodiment, the dielectric substrate should have a dielectric constant of about 7 to about 9. The preferred dielectric material is a low loss ceramic having a dielectric constant of 9.15. As commonly used in printed circuit boards, an FR-4 substrate material can be used instead, but a larger antenna structure will result since the dielectric constant of FR-4 is nominally 3.4. However with the configuration of the present invention the slots 123 and 133 in the first embodiment and 223 and 233 in the second embodiment can be placed closer together without appreciable mutual coupling.

Antenna diversity switch 245 is coupled to the first notch antenna 220 and the orthogonal third notch antenna 250 to provide polarization diversity. The antenna diversity switch 245 is preferably made of a monolithic switch or a discrete PIN diode, which can be co-located on the substrate 210 with the other components. A receive amplifier 240 is coupled to the antenna diversity switch 245. A transmit amplifier 250 is coupled to the second notch antenna 230. A digital signal processor 160 is coupled to the receive amplifier 140 and the transmit amplifier 150. A compact polarization diversity receiver with separate transmitter is thus provided while avoiding the need for a duplexer or transmit/receive switch as well as being disposed on the same substrate as the antenna elements. A compact antenna structure for a radio apparatus is thus provided.

For diversity applications that use a single receiver, an antenna diversity switch could be used to select between the antenna elements 220 and 230. Since the antenna elements 220 and 230 may be too closely located, the co-polarized slots may not show sufficient de-correlation for the desired diversity gain. In this case, a diversity configuration using the two orthogonally polarized elements would be preferred.

If polarization diversity is not desired, the center third antenna 250 can be used for transmit and spatial diversity is provided by using receive antennas 220 and 230 for reception.

Figure 3:
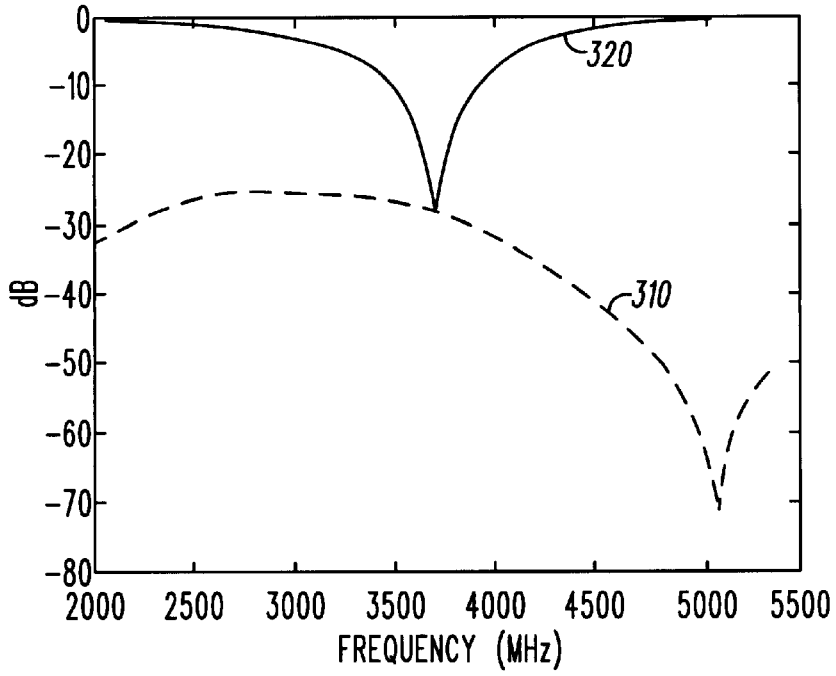
FIG. 3 illustrates a chart demonstrating performance characteristics of the antenna elements of the first embodiment of the present invention.

FIG. 3 illustrates a chart demonstrating for the antenna elements 120 and 130 configured according to the first embodiment of the present invention when excited around the intended operating frequency of 3.7 GHz.

Isolation curve 310 shows the isolation between a driven notch antenna 120 and the other coupled antenna 130 of the first embodiment. The in-band isolation is about 30 dB, which is substantially better than prior configurations. To establish a frame of reference for the isolation curve 310, a return loss curve 320 is also illustrated in FIG. 3. Each of the antenna elements is well matched and properly tuned as demonstrated by this return loss curve 320.

Figure 4:
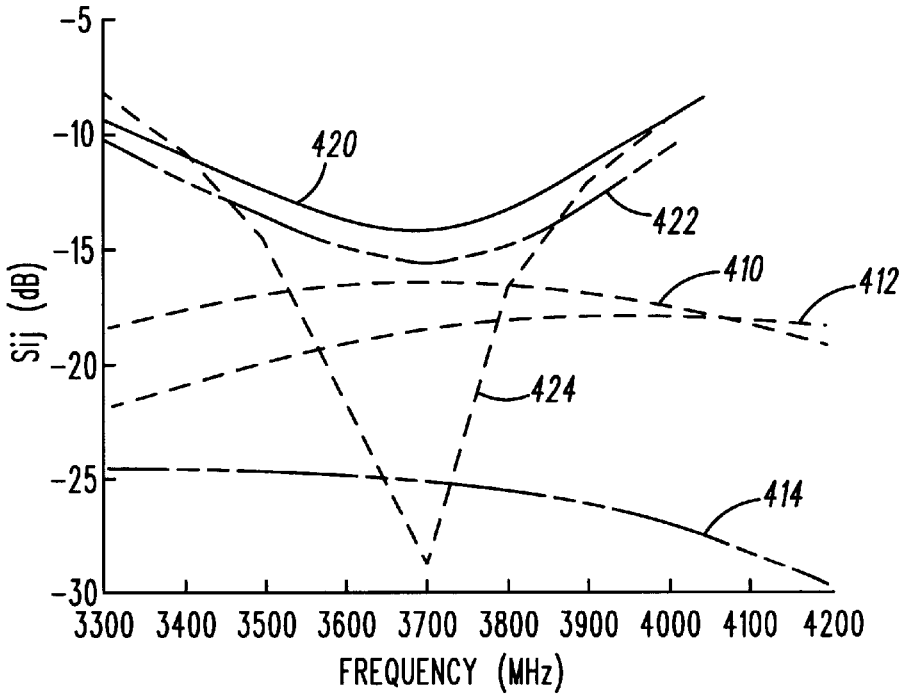
FIG. 4 illustrates a chart demonstrating performance characteristics of the antenna elements of the second embodiment of the present invention.

FIG. 4 illustrates a chart demonstrating for the antenna elements 220, 230 and 240 configured according to the second embodiment of the present invention when excited around the intended operating frequency of 3.7 GHz. Isolation curves 410 and 412 show the isolation between a respective driven first or second notch antenna 220 or 230 and a third center slot antenna 250 of the second embodiment. Isolation curve 414 shows the isolation between a driven first notch antenna 220 and the other notch antenna 230. The in-band isolation of the three curves 410, 412 and 414 are all better than 17 dB, which is substantially better than prior configurations. Note that the isolation is somewhat compromised due to the compact placement of all three notches and would be better if the three antennas were spaced further apart.

To establish a frame of reference for the isolation curves 410, 412 and 414, return loss curves 420, 422 and 424 are also illustrated in FIG. 4 to demonstrate that each of these three antenna elements is well matched and properly tuned. The return loss curves 420, 422 and 424 correspond to respective first, second and third antenna elements 220, 230 and 250.

Although the invention has been described and illustrated in the above description and drawings, it is understood that this description is by example only, and that numerous changes and modifications can be made by those skilled in the art without departing from the true spirit and scope of the invention. Although the examples in the drawings depict only example constructions and embodiments, alternate embodiments are available given the teachings of the present patent disclosure. For example a plurality of pairs of slots and other slots can be provided according to the configuration principles of the invention to make up antenna arrays. The drawings are for illustrative purposes and, although relative sizes can be seen, they are not drawn to scale.

What is claimed is:

1. A slot antenna structure having independent antenna elements, comprising:

a multilayer dielectric substrate, wherein one layer comprises a conductive layer;

a pair of coplanar elongated slots in the conductive layer configured in a substantially collinear fashion with one another and utilized as electrically independent antenna elements;

a pair of transmission lines of conductive traces on the multilayer dielectric substrate, each of the transmission lines coupled to a respective slot;

another slot configured between the pair of the slots in the conductive layer, the another slot additionally utilized as an electrically independent antenna element; and another isolated transmission line of a conductive trace on the multilayer dielectric substrate.

2. An antenna structure according to claim 1, wherein the pair of the slots are a pair of notches configured in directions opposing one another.

3. An antenna structure according to claim 1, wherein the another slot is orthogonally configured relative to the pair of the slots.

4. An antenna structure according to claim 3, wherein the pair of the slots are a pair of notches configured in directions opposing one another.

5. An antenna structure according to claim 1, wherein the transmission lines each comprise approximately a quarter wavelength of transmission line at a frequency of interest beyond a point of excitation of each slot.

6. An antenna structure according to claim 1, wherein the transmission lines each comprise at least one bend in each transmission line located beyond the point of excitation.

7. An antenna structure according to claim 1, wherein each transmission line excites its respective slot near an end of the elongated slot.

8. An antenna structure according to claim 1, wherein the transmission lines each comprise a micro-strip transmission line.

9. An antenna structure according to claim 1, wherein a first slot of the pair of slots and a first transmission line of the pair of transmission lines makes a first antenna;

wherein a second slot of the pair of slots and a second transmission line of the pair of transmission lines makes a second antenna;

wherein the another slot and the another transmission line makes a third antenna; and wherein the antenna structure further comprises a receive amplifier and a transmit amplifier and two of the first, second and third antennas are coupled to the receive amplifier and a remaining of the first, second and third antennas is coupled to the transmit amplifier.

10. An antenna structure according to claim 9, wherein the antenna structure further comprises a receive antenna diversity switch that couples the receive amplifier between the two of the first, second and third antennas.

11. An antenna structure according to claim 10, wherein the receive antenna diversity switch is disposed on the multilayer dielectric substrate.

12. An antenna structure according to claim 1, wherein the antenna structure further comprises circuitry disposed on the dielectric substrate and coupled to the transmission lines.

13. An antenna structure according to claim 8, wherein the transmission lines each comprise approximately a quarter wave length of transmission line at a frequency of interest beyond a point of excitation of each slot.

14. An antenna structure according to claim 1, wherein a first slot of the pair of slots and a first transmission line of the pair of transmission lines makes a first antenna, wherein the first antenna is coupled to a transmit amplifier; and wherein a second slot of the pair of slots and a second transmission line of the pair of transmission lines makes a second antenna, wherein a second antenna is coupled to a receive amplifier.

15. An antenna structure according to claim 14, wherein the transmit amplifier and the receive amplifier are disposed on the multilayer dielectric substrate.

* * * * *